United States Patent [19]

Yazdani et al.

[11] Patent Number: 4,949,082

[45] Date of Patent: Aug. 14, 1990

[54] HIGH SPEED DISPLAY DEVICE

[75] Inventors: Armand Yazdani; Coeman L. S. Wong, both of Toronto, Canada

[73] Assignee: NEI Canada Limited, Rexdale, Canada

[21] Appl. No.: 215,780

[22] Filed: Jul. 6, 1988

[51] Int. Cl.[5] ..... G09G 3/34

[52] U.S. Cl. ..... 340/783; 340/815.05; 340/764

[58] Field of Search ..... 340/763, 783, 815.05, 340/815.26, 815.27, 815.31, 764; 40/449, 451, 452, 475; 350/269

[56] References Cited

U.S. PATENT DOCUMENTS

| | | | |
|---|---|---|---|
| 3,648,281 | 3/1972 | Dahms . | |
| 4,160,583 | 7/1979 | Ueda | 350/269 |
| 4,163,332 | 8/1979 | Salam | 340/764 |
| 4,794,391 | 12/1988 | Costa et al. | 340/815.31 |
| 4,825,205 | 4/1989 | Lee | 340/763 |
| 4,839,635 | 6/1989 | Harris et al. | 340/815.31 |

FOREIGN PATENT DOCUMENTS

| | | |
|---|---|---|
| CH393143 | 3/1965 | European Pat. Off. . |
| 2517445 | 12/1981 | European Pat. Off. . |
| 2045991 | 11/1980 | United Kingdom . |

*Primary Examiner*—Jeffery A. Brier

[57] ABSTRACT

Display element has electromagnetic drive and two rotatable vanes which exhibit a display area to the viewer in ON mode and occlude it in OFF mode. Side walls may be used to prevent viewing the display area from the side in the OFF mode.

21 Claims, 3 Drawing Sheets

HIGH SPEED DISPLAY DEVICE

Figure 2:
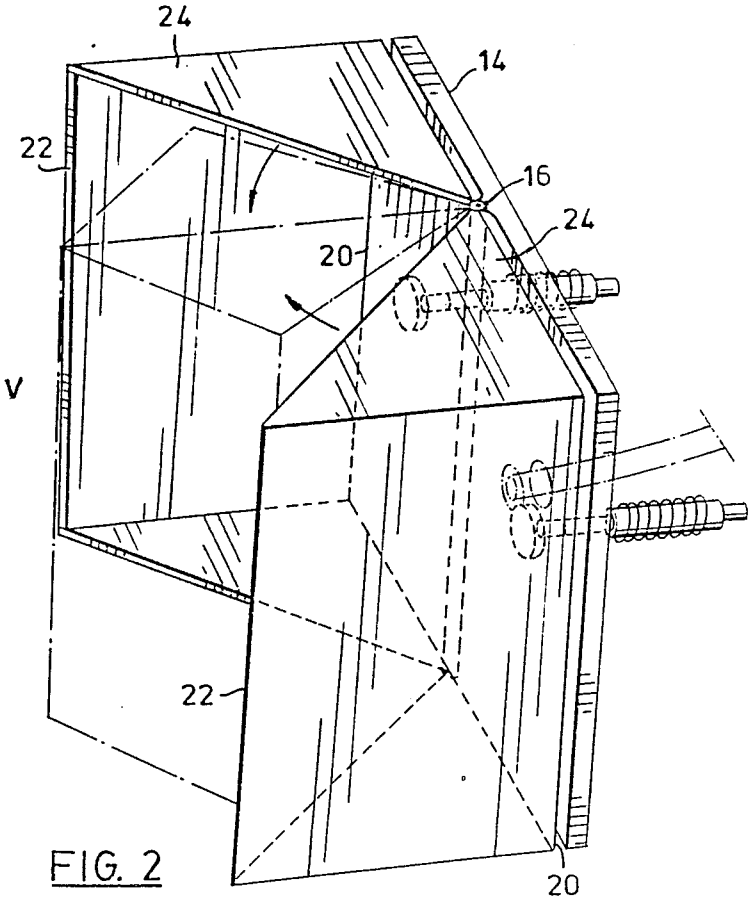

This invention relates to a display or indicating device wherein pivotally mounted elements are of the type designed to be electromagnetically driven and to selectively display one of two contrasting appearances in a viewing direction and where the device may be used by itself as a binary indicator or in an array to produce symbols or indicia by the combined appearance of a number of such devices.

Many of such devices have in the past depended on the use of a diametrically pivotted disk, contrastingly colored on opposite sides and requiring a 180° or near 180° rotation between the positions which display the contrasting faces in the viewing direction. Such 180° rotation requires an amount of time which is undesirable in what should be a rapidly changing display. Further it is difficult to sustain good magnetic drive torque over the entire 180° range. Such disadvantages are present in a lesser degree in devices requiring 90° rotation.

It is an object of the present invention to provide a display device wherein a pair of pivotally mounted vanes are each designed to move between two limiting positions less than 90° apart and preferably about 45° apart. The vanes are electromagnetically controlled and driven between limiting positions. The small rotation angle tends to provide a relatively rapidly changeable display. Further it is much easier to provide good magnetic drive torque over the smaller angular range.

The invention, in a preferred aspect, provides a display device electromagnetically switchable between a display of ON mode and an occluded or OFF mode and designed to show a display of contrasting colors in the ON and OFF modes in the viewing direction. The invention comprises a pair of vanes, each being a flat panel oriented to have its plane parallel to the viewing direction in the ON position with the two panels parallel and spaced to define between them a viewing area of the device. The vanes are pivotally mounted to allow their rotation to the OFF position where the panels are designed to occlude the viewing area from the viewer. The appearance of the backs of the vanes, visible in the viewing direction in the OFF position is designed to contrast with the viewing area displayed in the ON position to produce the contrasting effects.

Definitions:

'Viewing area' is that portion of the device designed to be seen by the viewer in the ON position of the device and to be hidden or occluded from the viewer in the OFF position. The color of the viewing area must contrast with that portion of the the device which hides or occludes the viewing area in the viewing direction in the OFF position. (See also 'panel'.)

'Viewing direction' is the median direction in a predetermined cone for viewing the device. The cone need not be a surface of revolution.

'Vane' is that part of each rotating element which is directed edgewise toward the viewer in the ON position of the device and to display the viewing area; and which hides the viewing area in the OFF position of the device.

'Panel' is a flat portion of the rotating element and can include a vane. In one embodiment two panels at right angles comprise, respectively, the vane and a part of the viewing area. It follows that the 'viewing area' may be a stationary area behind the vanes or a panel movable with the vane and visible in the viewing direction in the ON mode.

Viewing lines which are located in a plane (the 'median plane') including the viewing direction and perpendicular to the pivotted axes of the rotating element will be interrupted by the vanes in the OFF position. However viewing lines removed from such plane could, in the preferred embodiment, allow viewing the viewing area outside the vane edges in the OFF position.

'Walls' are those members designed to interrupt, in the OFF position of the device, viewing lines from directions at an angle to that median plane. Such a wall may be stationary, located just to the side of the locus of the vane in its movement between ON and OFF position or such a wall may be attached to the side edges of the vanes to rotate therewith.

The 'median plane' is that plane containing the viewing direction and perpendicular to the pivotal axis for a vane. The two vanes will usually pivot on parallel axes and define the same median plane.

In a preferred form of the invention described in the previous paragraph the areas of the panels which face each other in the ON position of the device are colored to match the color of the viewing area and to contrast with the color displayed in the viewing direction in the OFF position. The panel coloring increases the effective area of the device in the ON position when viewed along viewing lines near to but somewhat diverging from the viewing direction and thus widens the locations from which the sign may be viewed.

When the vanes assume their attitude for the OFF position, there will be locations whose viewing lines, oriented at an angle to the median plane, from which the contrasting display area can be seen even though the vanes are in a position to occlude the display area in the viewing direction. The invention therefore preferably provides side walls which cooperate with the vanes in the OFF position of the latter to block the display area from the viewers along viewing lines so oriented. On the other hand such side :walls on their sides which face inward over the viewing area may be colored to correspond to the viewing area to increase the angle from which the display device may be viewed in the ON position In other words there are locations at an angular deviation from the median plane from which the viewing area must be blocked by the side walls in the OFF position, since from such directions the viewing area would not be obscured by the vanes. On the other hand the surfaces of the side walls facing toward the side of the viewing area are similarly colored to it, to widen the angle from which the ON color of the display device may be viewed.

In one embodiment of the invention the vanes form the outer panels of plates having inner panels with a 90° bend between inner and outer panels in them and are thus L-shaped in cross-section. Each plate is pivotted to the base at axes on edges of the panels spaced from the bend line. In this embodiment, the area of the inner panel which is between the pivot axis and the bend line is substantially perpendicular to the viewing direction in the ON position and the exposed inner panel areas of the two vanes thus form (together with any area on the base between the pivotal axes) the viewing area in the ON position. The plates and their vanes (outer panels) are designed so that, in the OFF position, the edges of the outer panel remote from the bend line meet, so that the vanes collectively occlude the viewing area in the viewing direction.

In a preferred embodiment with said L-shaped plates, side walls form a generally triangular shape on each side of each plate with one side of the triangle meeting each side edge of a panel and the hypoteneuse extending from the pivot axis to the free edge of the outer panel. Such side walls act, in the OFF position, to block the viewing area from viewers in locations off the median plane. On the other hand the side walls on their inside surfaces are colored to conform to the color of the viewing area and in the ON position of the vanes increase the angle of directions to the median plane through which the element may be viewed.

In another embodiment of the invention the vanes are flat plates preferably rectilinear and pivotted at one pivotal axes (a stationary surface on the base member) defining the viewing area. The plates are designed so that their edges remote from the pivot axis meet in the OFF position to occlude the viewing area. The plates extend toward the viewer in the ON position, to be seen edgewise and thus to be barely visible. Thus the rotation of the vanes between ON and OFF position may be over a range of angles greater to less than 45° depending upon the length of the plates relative to the spacing between their pivotal axes.

Side wall members are provided to occlude the viewing of the viewing area wall member from directions off the median plane of the sign. Such wall members may be located on the sides of the vanes or may be stationary.

It is preferred that the surfaces of the vanes and of the walls which face the viewing area are similarly colored to increase the viewing angle with the device in the ON position in angles measured in the median plane and from the median plane, respectively.

The embodiment of the invention where the vanes are flat plates has a number of advantages over the version with the L-shaped elements. The flat vanes are lighter and therefore respond more rapidly to the magnetic drive, giving a faster visual switch-over time. The flat vanes are simpler to manufacture. Without attempting a survey of all possible magnetic drives, the flat vanes appear to lend themselves to drives with better magnetic torque. The flat vanes further allow convenient back lighting arrangements.

In both the L-shaped elements, and the flat vanes where the display area is rectilinear and the vanes are edge mounted it should be noted that the display area may encompass the entire area of the display device. It is of particular value when a number of elements are used in an array to have the whole area of each device occupied by the display. This is in contrast to arrays made up of circular disks diametrically mounted where the area located between the outlines of a square and that an inscribed circle is wasted space in the sense it does not alter with the display and therefore tends to detract from the display appearance.

In both embodiments an aperture may be made in the display area and an optic fibre led from behind the device to a free end in front of the display area. The fibre thus, in the ON position supplies night illumination for the display area and radiates directly to the viewer while in the OFF position it is occluded to the viewer by the vanes and side walls. The location of the fibre illumination in front of the viewing area means that a large proportion of such illumination is used, either directly to provide illumination to the viewer or to illuminate the viewing area and the facing sides of the vanes and side walls. This is in contrast to prior methods for combining optic fibre illumination with a display and visible to the viewer through an aperture. In such case radiation from the fibre, other than a narrow cone defined by the aperture is lost to the viewer because it does not get through the aperture.

Figure 1:
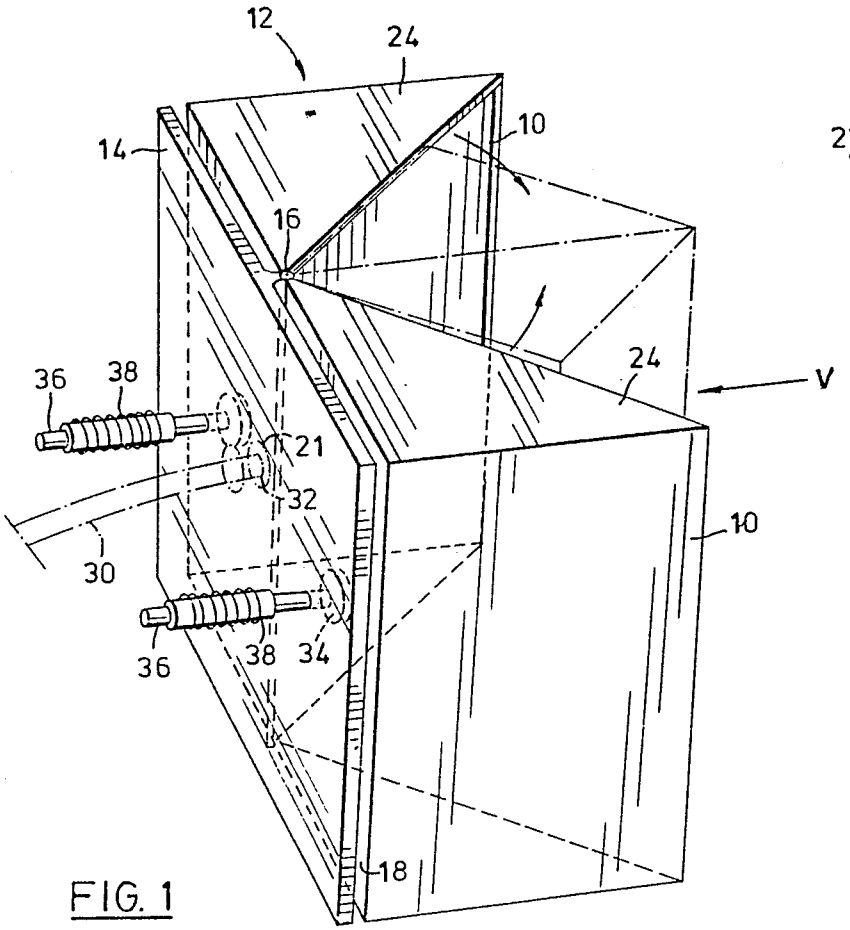
Figure 4:
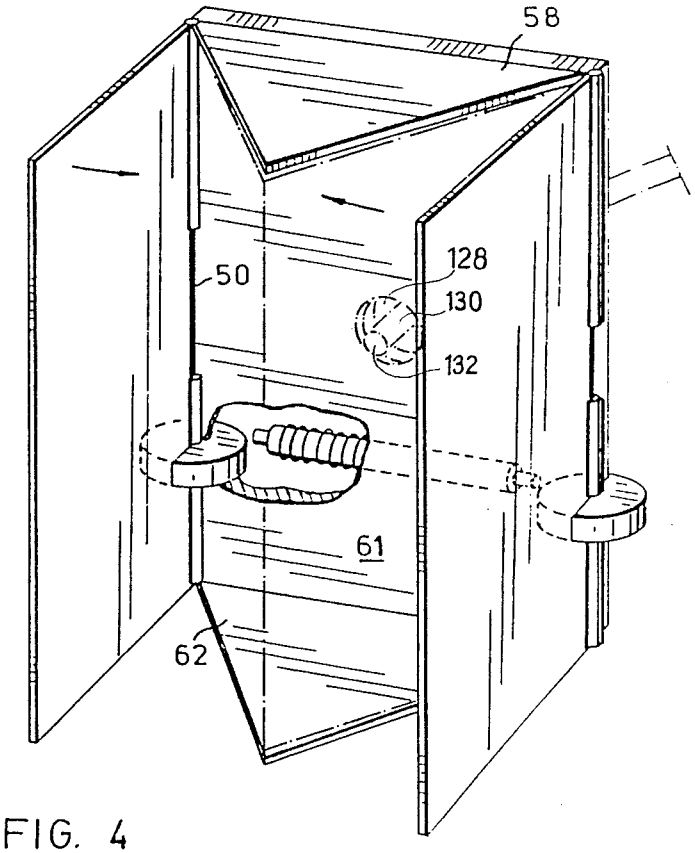
Figure 3:
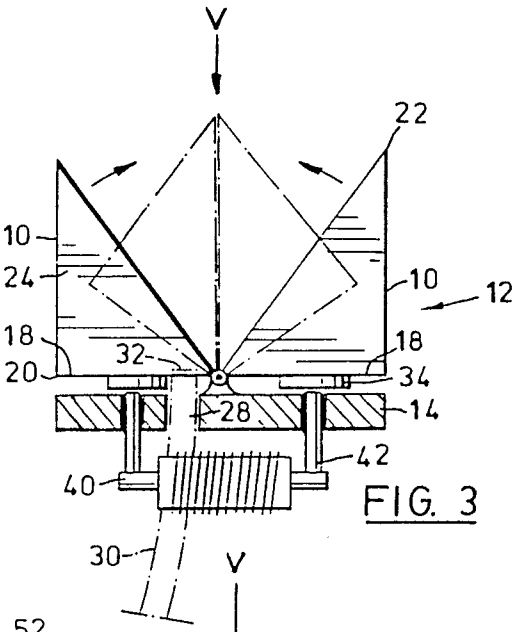
Figure 5:
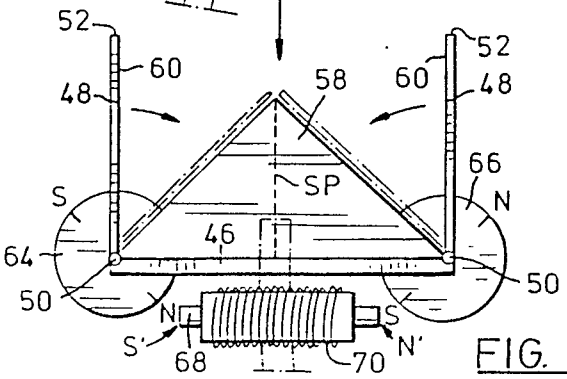
Figure 7:
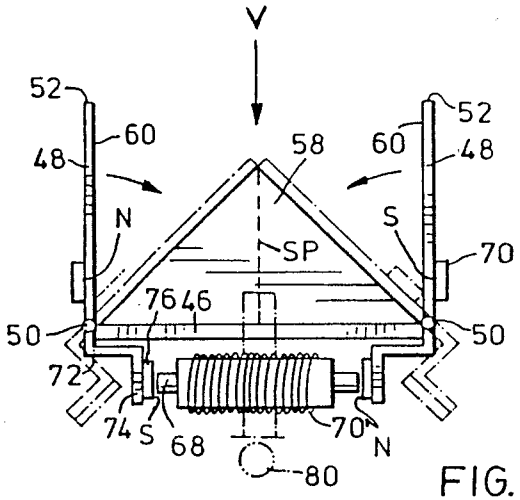
Figure 6:
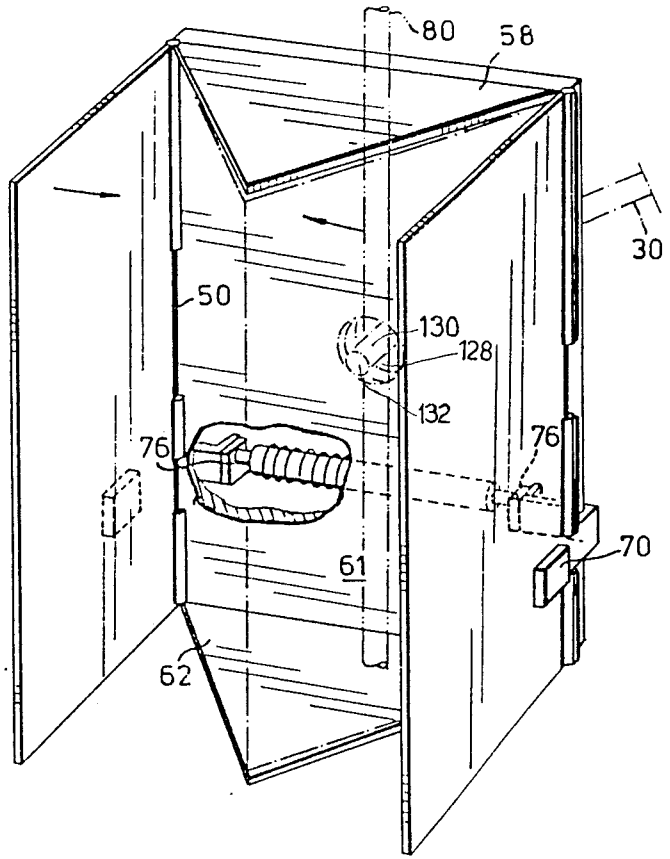

In drawings which illustrate a preferred embodiment of the invention:

FIG. 1 shows a perspective, from the rear, of a display device using vanes which are flat plates; and FIG. 2 shows a perspective, from the front, of the device of FIG. 1, FIG. 3 is a section, perpendicular to the viewing axis of the device of FIG. 1, but showing an alternative magnetic drive to that of FIGS. 1 and 2, FIG. 4 is a perspective view, from the front, of an alternative form of the invention where the vanes are flat plates, FIG. 5 is a side view of the device of FIG. 4, FIG. 6 shows a perspective of a form of the invention similar to FIG. 5 but using a different magnetic drive, and FIG. 7 is a side view of the device of FIG. 5.

The drawings show the viewing direction V, being the median direction of a cone which includes locations from which the sign is intended to be viewed. The median plane is the plane including direction V and perpendicular to the the two vane rotation axes (which are paralled in the preferred embodiment).

FIGS. 1 to 3 show one preferred form of the inventive display device (FIG. 3 showing an alternative magnetic drive) wherein each vane 10 is made of a right angle L-shaped plate 12 pivotted to the base 14 at a pivotal axis 16 which may be, as shown, a common pivotal axis for both vanes. The L-shaped plate 12 is made up of two rectilinear panels being outer panel or vane 10 and inner panel 18 has one edge of panel 18 mounted on the pivot axis and in the ON position panel 18 extends outwardly along the base 14 and perpendicular to the viewing direction V. In the ON position the outer panel, that is vane 10, extends from the plate bend line 20 in the viewing direction. The outer edges 22 of the vanes 10 are designed to meet when the vanes rotate to OFF position. In the ON position it will be seen that the viewing area is defined by the inner surfaces of panels 18 and also seen that the outer vane edges 22 and the vanes oriented edgewise to the viewer would be substantially invisible to most viewers. The inner faces of the vanes 10 are colored similarly to the viewing areas of panels 18 and effectively add to the contrasting area of the device for viewers at locations angularly offset from the viewing direction along location displaced in directions with a major component in the median plane.

The dotted line position shown in FIGS. 1, 2, and 3, shows the OFF position of vanes. The outer edges 22 of the vanes meet to occlude the viewing area positions thereof to a viewer looking in the viewing direction and located on the median plane. The outer edges 22 of the vanes 10 are designed to meet and may themselves act as mutual stops for the vanes when moving toward OFF position.

In the closed position the viewing areas of panels 18 will be visible to viewers standing at locations displaced from the median plane. Accordingly side walls are provided to avoid this. In the preferred arrangement the side walls are triangles 24 bounded by the side edges of the vanes and panels 18 and a line forming the hypoteneuse joining the outer edge 22 and the pivoted edge of the vanes 10; and walls 24 are part of the vanes and rotate therewith. The inner surfaces of the walls 24 are colored in the color of the viewing area to effectively increase the ON area of the device to viewers displaced from the median plane. If desired the side walls 24 could have been fixed and mounted on the base 14 at each side edge of the plates 12 and having their planes parallel to the viewing direction, and disposed closely to the locus of the side edges of the plates 12 which may sweep by them in movement between ON and OFF position. Such stationary side plates may be of any shape and might have a rectilinear shape conforming to the outer areas of the vanes 10 in their open position to form an open box of uniform height in the ON position, for better viewing on viewing lines at an angle to the median plane. The inside coloring of the stationary side walls would for this purpose conform to that of the viewing area.

The rotation of the vanes may be more or less than 45° to the degree that the vanes 10 have shorter or longer extents from the bend line 20 than panels 18. At any angular rotation of about 45°, this embodiment has the speed and magnetic drive advantages consequent upon using a 45° angular rotation instead of prior angular rotations of 90° or 180°.

In this particular instance it is desired to describe the visual effect of the device so far described. In FIGS. 1–3 the solid line positions show the ON position in which a viewer looking in the viewing direction or in a predetermined cone therearound will see the viewing area comprised of panels 18 and the inner surfaces of vanes 10 or of walls 24 all in the same first color. In the dotted line or OFF position of the device, the viewer within the intended cone for viewing will see the outside of the vanes, the outside of side walls 10 and perhaps part of the base. All these latter surfaces will be colored in a color contrasting to the first for good visual contrast. It will be noted that in the ON position the panels 18 together forming the viewing area, together occupy substantially the entire area of the device so that, with an array or matrix of such devices, all the area is used for visual effects.

If it is desired to augment the effect of the design for night viewing, one of the panels 18 may be apertured at 28 and optic fibre 30 provided mounted on the base to project through the aperture to a free end 32 located forward of panel 18 in the ON position of the vanes. Thus in the ON position, the illuminated fibre end 32 renders the viewing area and inside surfaces of vane and panels more visible to the viewer as well as itself providing an indication to the viewer. Widely divergent rays from the fibre end are used to reflect from the surfaces. In prior art arrangements the use of the fibre end behind the aperture only allows a very narrow cone of light therefrom to be visible and widely divergent rays never pass the aperture or reach the viewer.

In FIGS. 1–3 the free end 32 of the fibre is introduced through an aperture in one of the vanes. However, if desired the fibre end may be centrally introduced along the viewing axis. For this purpose (not shown in the drawings) the pivot axis would be provided at each end only, and absent from the middle, while the meeting edges of panels 18 are cut back to provide the aperture for the fibre and the base 14 would be provided with an aligned aperture.

As a magnetic drive it is preferred to use the drive shown using permanent magnets 34 located on the back of panels 18 and magnetized perpendicular to the plane of such said panel. A pair of cores 36 may be provided oriented parallel to the viewing direction with energized windings 38 as shown. The cores are simultaneously activated to repel or attract the permanent magnets to drive the magnets and vanes between ON and OFF positions. The location of the permanent magnets 34 relative to the pivot axes 16 is a matter of design consideration.

Location of the magnets farther from the pivot axis will increase the magnetic torque arm. However it will also increase the air gap in the OFF position requiring a larger MMF (magneto motive force) to pull the magnets and members 12 back to ON position and to push the magnets and members to the OFF position.

If, as is preferred, the core is made of permanently magnetizable or 'hard' magnetic material two advantages accrue. The magnetizations of cores 36 may be reversed by a pulse in the energizing windings 38 of very short duration and independent of the longer time which the members 12 will take to mechanically respond. Secondly the core 36 retains its polarity after the pulse so that if the vanes are displaced by wind or impact from the desired position the continuing core flux will return then to the desired position.

The embodiment of FIGS. 1 and 2 may use the electromagnetic drive of FIG. 3, FIG. 3 shows an alternate magnetic core arrangement where a single preferably 'hard' magnetic core 40 is used, extending perpendicular to the viewing direction. Soft iron core extensions 42 are provided at each end of the hard magnetic core with the extensions directed into proximity to the magnets 34. The use of the soft iron extensions 42 does not destroy the 'hard iron' character of the magnetic drive with its previously stated advantages.

Alternatively the members 12 of FIGS. 1–3 may be driven as are the rotating members of FIGS. 4–5 by attaching cylindrical magnets 64, 66 diametrically magnetized (not shown in FIGS. 1–3), attached to the panels 18 for rotation therewith to be driven as in the drive of FIG. 4 and 5. The drive core may again be hard iron. The disadvantages of the use of cylindrical magnets with the FIG. 1–3 embodiment is that the panels 18 must be slotted to allow the magnet for one panel 18 to rotate free of the other panel 18 thereby reducing the viewing area.

An alternative embodiment of the invention shown in FIG. 4 and 5 shows a base place 46 whose rectilinear outline defines a viewing area 61. The viewing area could merely be the appropriately colored forward surface of plate 46. However area 61 will usually be embodied by appropriately colored synthetic tape attached to plate 46. A pair of rectilinear vanes 48 are pivotally mounted on edge 50 to rotate on parallel axes between a solid line ON position parallel to the viewing direction V and an OFF position where edges 52 (opposed to edges 50) meet. Preferably the dimension from pivot edge 50 to opposite edge 52 is about $\sqrt{2}/2$ of the spacing between the pivot axes 50 so that the rotation from ON position (solid lines) to OFF position (dotted lines) is about 45°. Stops for the ON position and OFF limiting positions are not shown but it will be appreciated that these may be provided in a large number of conventional ways. It will be noted that in the OFF position, the vanes 48 form a vee or roof shape (best shown in FIG. 5) with what would be open ends. There are provided triangular side walls 58 fixed to the base 46 to close these open ends and occlude the viewer's area to viewers offset from the median plane. The faces 62 of the walls 58 which face the viewing area are visible to viewers offset from the median plane and hence are colored to correspond to the viewing area. If the device is considered as viewed in the dotted line or OFF position it will be seen that the vanes 48 and side walls 58 act to occlude the viewing area 61 to viewers. If the device is considered as viewed in the solid line or ON position it will be seen that the inner faces of the side walls 60 and vanes 48 effectively add to the contrasting face area of the viewing area 1 to widen the directions from which the ON device may be seen in cone about the median viewing direction. The side walls 58 are shown as fixed and triangular. It will be obvious that, if desired, these side walls could be rectilinear near in shape with the vanes designed to sweep by them to the OFF position and with the rectilinear panels being similarly colored to the viewing area on their inner sides.

Alternatively, if desired, the triangular side walls 58 shown in FIG. 4 and 5 could be divided along line SP and attached to rotate with the vanes 48 instead of being attached to the stationary base.

The outside of the vanes and of side walls 58 is colored to contrast to viewing area 61.

Various electromagnetic drives may be used. All will have the advantage over the drives for other devices in that for the (about) 45° rotation a quicker transition between ON and OFF may be achieved both because of the small angle of movement and because over such small angle good magnetic torque is easier to provide. The ability to provide good magnetic torque further reduces the likelihood of hang ups.

In the preferred magnetic drive shown, the base 46 is provided with slots in those edges parallel to the rotary axis. The slots project perpendicular to the axis. Attached to the vanes 48 to rotate therewith in such slots are the cylindrical magnets 64 and 66 coaxial with the vane rotation axis and magnetizable with a polar axis across the diameter. As shown in FIG. 5, in the ON position of the vanes, the N and S poles are offset about 45° from the vane direction.

An electromagnetic core 68 with energizing coil 70' is mounted by means not shown to extend parallel to and behind the viewing area between the loci of magnets 64 and 68. In the solid line position of FIG. 5 the magnets are attracted to move the vanes to ON position when the core is polarized to provide poles N', S' as shown. When the coil is energized to reverse the polarity of the core poles the-core flux drives the permanent magnets and vanes to dotted line OFF position. Further reversal of the core polarity will again drive the permanent magnets and the vanes to ON position.

It will be obvious that the round magnets could be used if the core drive of FIG. 3 is used with the device of FIG. 4 if the magnet axis is rotated 90° (clockwise for magnet 64 and counter clockwise for magnet 66).

It is a disadvantage of the alternative of FIG. 4 and 5 that the magnets project beyond the edges of the base so that the display area is smaller than the area occupied by the device as seen in the viewing direction.

A soft iron core 68 may alternatively be used within the scope of the invention with the diametrically magnetized magnets 64 and 66. With the soft iron core the energization must be continued until the magnets have moved (or under inertia will move) sufficiently for the opposed permanent magnet poles to be within the attraction of the core ends as dictated by the new magnetic polarity. They will and do retain their position due to the permanent magnet affect upon the soft iron core after energization has ceased. However if a vane in one position is displaced by chance (wind or impact) to the other position it will stay due to the attraction between the permanent magnet and the deenergized soft iron core. Although other vane and viewing area shapes are available, the rectilinear shapes are thought to provide the highest area coverage when a number of such devices are used closely spaced, in a matrix or array.

A soft iron core is less practical with the magnets 34 since a special arrangement would have to be provided to hold the device in OFF position.

FIGS. 6 and 7 show an alternative magnetic drive for the device of FIGS. 4 and 5 and, for most purposes the embodiment of FIGS. 6 and 7 the action and operation of vanes 48, base plate 46, display area 61 and side walls 58, core 68 and coil 70' is the same as described in connection with FIGS. 4 and 5 and will not be repeated here. A strip 72 extends from the vane a short distance rearwardly of the pivot point, is bent inward at right angles then backward to form a support 74 for a permanent magnet 76. At the open, limiting position of the vanes solid line in FIG. 7 the magnet ends are located in proximity to the ends of the magnetic core 68. On each vane, forwardly of the pivot point is a permanent magnet 70. The magnet 70 is located on the vane where it will approach, the end of core 68 in the OFF position of the vane. The magnets 76 and 70 are all polarized perpendicular to the plane of the vane. The two magnets 70 are oppositely polarized and each magnet 70 is polarized opposite to magnet 76 on the same vane. Polarities of magnets 70 and 76 nearer the core ends are indicated in FIG. 7. In operation the ends of core 68 are oppositely polarized. On the polarity coinciding with the solid line ON position of FIG. 7, the core end attract the magnets 74 and repel the magnets 70. When the core polarity is reversed the magnets 76 are repelled and the magnets 70 attracted driving the vanes to OFF position. Further reversal repels magnets 70 and attracts magnets 76 to again drive the vanes to ON position. The magnets 70 have less effect than magnets 76 but assist in the operation of the device particularly when, in the OFF position, magnets 76 are far from the core ends, the reversal of the core polarity uses the repulsion of magnets 70 to assist in the drive to ON position.

It will be noted that strips 72 are on one side of the position half way along the pivot axis. This allows adjacent devices (in the direction perpendicular to the pivot axis) to be reversed so that the strips are displaced toward opposite ends. Thus the slight projection of the strips 72 beyond the boundaries of the display area 61 in the OFF or dotted position of the element, does not mean that the elements may not be placed immediately adjacent each other, since end strip 72 projection laterally in the OFF position may be received below the base plate of the adjacent element.

The device of FIGS. 6 and 7 is suitable for back lighting. In such arrangement base plate 46 and display area 61 are made transparent or translucent. The preferred arrangement is to make base plate 46 transparent and to form the display area of a translucent tape to provide the required color under daylight condition and to give the same color with diffused light from back lighting. The back lighting may be of any suitable type. As an example a portion of a fluorescent tube 80 is shown in the drawings. Such a tube would 'back-light' a series of elements. However the elements could be collectively or individually lit since, in either case, the vanes would obstruct the light to the viewer through the display area in the OFF position and allow light to pass to the viewer in the ON position.

The alternative of FIGS. 4 and 5 is equally adaptable for back lighting.

As stated in the introduction the flat vane devices of FIGS. 4 and 5, and of FIGS. 6 and 7 have the advantage that: they are lighter and respond better to the magnetic drive and lend themselves to better torque and are amenable to back lighting arrangements.

The devices of FIGS. 6 and 7 and of 1–3 have the advantage that the devices may be placed immediately adjacent each other to form a visually efficient display.

The embodiment of FIGS. 4 to 7 show optic fibres 130 projecting through aperture 128 in plate 61 to fibre end 132. The fibre end is visible when plates 48 are open and occluded to the receiver when plates 48 are closed.

Mechanical details such as pivotal mountings, core and will support base mounting and other structural details are omitted as being providable by conventional measures to those skilled in the art.

I claim:

1. Display or indicating element selectively displaying one of two contrasting colors in a viewing direction, a pair of rigid rotatable vanes which are substantially flat plates rotatable on parallel axes on a base, each rotatable between two limiting positions, less than 90° apart, said limiting positions being a first 'ON' position where said vanes extend in the viewing direction at spaced locations to define a display area therebetween, and a second 'OFF' position where said vanes slope inwardly to meet and obscure the display area to a viewer in the viewing direction, permanent magnet means mounted for rotation on each of said vanes, stationary reversibly magnetizable, electromagnetic means located for use in cooperation with said permanent magnet means to drive said vanes to said 'ON' and said 'OFF' position responsive to one and the other magnetization of said electromagnetic means, whereby said electromagnetic means in cooperation with said permanent magnet means creates good magnetic torque to drive said vanes over the less than 90° angle and provides for rapid switching between 'ON' and 'OFF' positions.

2. Display or indicating element as claimed in claim 1, where side plates are located at each end in the axial direction of the locus of movements of said vanes designed to prevent viewing of said display are in the 'OFF' positions from directions forming an angle to a median plane containing the viewing direction and perpendicular to the parallel axis.

3. Display or indicating element as claimed in claim 1 where said vanes are flat plates having opposite straight edges, being pivotally mounted at one of said opposed edges with the edges of the respective vanes opposed to those pivotally mounted being designed to meet in said second position, wherein the mounting axes of said plates are spaced on said base and a viewing area on said base between said axes.

4. Display or indicating element as claimed in claim 2, wherein said vanes are flat plates having opposed straight edges, being pivotally mounted on one of said opposed edges, with the edges of the respective vanes opposed to those pivotally mounted being designed to meet in said second position, wherein the mounting axes of said plates are spaced on said base and there is defined a viewing area on said base between said axes.

5. Display or indicating element as claimed in claim 1 wherein each of said vanes is the outer of two panels joined by a 90° bend line, the inner panel being pivotally connected to said base along an edge on the opposite side of said panel from said bend line, said vane having a free edge on the opposite side of the outer panel from said bend line, said panels, pivots and edges being so arranged that said vane free edges meet in said 'OFF' position and where the outer surfaces of said inner panels together define the viewing area in said 'ON' position.

6. Display or indicating element as claimed in claim 2 wherein each of said vanes is the outer of two panels joined by a 90° bend line, the inner panel being pivotally connected to said base along an edge on the opposite side of said panel from said bend line, said vane having a free edge on the opposite side of the outer panel from said bend line, said panels, pivots and edges being so arranged that said vane free edges meet in said 'OFF' position and where the outer surfaces of said inner panels together define the viewing area in said 'ON' position

7. Display or indicating device as claimed in claim 6, wherein said side plates are attached to said vanes and, on each vane, extend from adjacent the pivotal axis to the free edge of said vanes and said side plates of each vane are shaped to cooperate with the side plates of the other vane to so prevent viewing.

8. Display or indicating device as claimed in claim 1 wherein an optical fibre is connected to an end located forwardly of said viewing area to be visible in the viewing direction in said 'ON' position and to be occluded by said vanes in said 'OFF' position.

9. Display or indicating device as claimed in claim 2, wherein an optical fibre is connected to an end forwardly of said viewing area to be visible in the viewing direction in said 'ON' position and to be occluded by said vanes in said 'OFF' position.

10. Display or indicating device as claimed in claim 3, wherein the means defining a viewing area is apertured and an optical fibre extends forwardly of said area through said aperture to a free end, and where said free end is located to be exposed in the 'ON' position of said vanes and occluded in the 'OFF' position.

11. Display or indicating device as claimed in claim 4, wherein the means defining a viewing area is apertured and an optical fibre extends forwardly of said area through said aperture to a free end, and where said free end is located to be exposed in the 'ON' position of said vanes and to be occluded in the 'OFF' position.

12. Display or indicating device as claimed in claim 5, wherein one of said inner panels is provided with an aperture and an optical fibre is connected to project forwardly through said aperture in the 'ON' position of said vanes.

13. Display or indicating device as claimed in claim 6, wherein one of said inner panels in provided with an aperture and an optical fibre is connected to project forwardly through said aperture in the 'ON' position of said vanes.

14. Display or indicating device as claimed in claim 5, wherein said vane on the side facing said display area is similarily colored thereto.

15. Display or indicating device as claimed in claim 6, wherein said vane on the side facing said display area is similarly colored thereto.

16. Display or indicating device as claimed in claim 12, wherein said vane on the side facing said display area is similarly colored thereto.

17. Display or indicating device as claimed in claim 13, wherein said vane on the side facing said display area is similarly colored thereto.

18. Display or indicating element as claimed in claim 3 wherein said base and display element are transparent or translucent and back lighting is provided to illuminate said area to viewers in the viewing direction in the ON position of said vanes but wherein said back lighting is blocked by said vanes to viewers in said viewing direction when said vanes are in OFF position.

19. Display or indicating device as claimed in claim 2 wherein said base and display element are transparent or translucent and back lighting is provided to illuminate said area to viewers in the viewing direction in the ON position of said vanes but wherein said back lighting is blocked by said vanes to viewers in said viewing direction when said vanes are in OFF position.

20. Display or indicating element as claimed in claim 18 wherein said base is transparent and said display area is formed by translucent tape attached to the front of said base.

21. Display or indicating element as claimed in claim 19 wherein said base is transparent and said display area is formed by translucent tape attached to the front of said base.

* * * * *